United States Patent [19]

Camp

[11] 4,395,351

[45] * Jul. 26, 1983

[54] POLYETHER-BASED THICKENERS WITH ADDITIVES FOR INCREASED EFFICIENCY IN AQUEOUS SYSTEMS

[76] Inventor: Ronald L. Camp, 14029 Cranbrook, Riverview, Mich. 48192

[ * ] Notice: The portion of the term of this patent subsequent to Jan. 12, 1999, has been disclaimed.

[21] Appl. No.: 252,165

[22] Filed: Apr. 8, 1981

Related U.S. Application Data

[63] Continuation of Ser. No. 86,836, Oct. 22, 1979, Pat. No. 4,310,436.

[51] Int. Cl.[3] ..... B01J 13/00

[52] U.S. Cl. ..... 252/315.1; 252/78.5; 252/DIG. 1; 568/624

[58] Field of Search ..... 252/316, 78.5, 174.16, 252/DIG. 17; 568/624, 680

[56] References Cited

U.S. PATENT DOCUMENTS

| | | | |
|---|---|---|---|
| 2,425,755 | 8/1947 | Roberts et al. | 568/625 |
| 2,674,619 | 4/1954 | Lundsted | 252/357 X |
| 3,101,301 | 8/1963 | Siegal et al. | 252/316 X |
| 3,475,499 | 10/1969 | Winnick | 568/680 |
| 3,535,307 | 10/1970 | Moss et al. | 536/4 |
| 3,538,033 | 11/1970 | Hayashi et al. | 568/611 X |
| 3,748,276 | 7/1973 | Schmolka | 252/316 |
| 3,829,506 | 8/1974 | Schmolka et al. | 568/624 |
| 4,086,279 | 4/1978 | Langdon et al. | 252/351 X |
| 4,310,436 | 1/1982 | Camp | 252/316 |

*Primary Examiner*—Richard D. Lovering
*Attorney, Agent, or Firm*—Andrew E. Pierce

[57] ABSTRACT

Polyether-based thickeners for aqueous systems, said polyethers having molecular weights of about 1000 to about 25,000 which are modified by reaction with at least one glycidyl ether having a carbon chain length of about 12 to about 18 carbon atoms, exhibit increased thickening efficiency in the presence of certain organic additives. These are ethoxylated phosphate esters or mixtures of said esters with water-soluble amines. The polyethers contain about 1 to about 20 percent by weight, based upon the weight of the liquid polyether, of a glycidyl ether. Polyether-based thickeners containing an ethoxylated phosphate ester, or said ester in admixture with a water-soluble amine, and thickened aqueous compositions are disclosed together with processes for the preparation of thickened aqueous systems. The polyether-based thickeners of the invention are particularly useful for thickening water or water-glycol mixtures which are useful as hydraulic fluids.

20 Claims, No Drawings

POLYETHER-BASED THICKENERS WITH ADDITIVES FOR INCREASED EFFICIENCY IN AQUEOUS SYSTEMS

This is a continuation of application Ser. No. 86,836, filed Oct. 22, 1979, now U.S. Pat. No. 4,310,436.

BACKGROUND OF THE INVENTION

1. Field of the Invention

This invention relates to thickeners for aqueous systems based upon polyethers of high molecular weight.

2. Prior Art

Polymeric water-soluble thickening agents are widely used for many purposes. Commercially available polymeric thickeners differ widely in chemical composition. The diversity of available thickening agents is an indication that not all are equally useful. It is not unusual to find some thickening agents which perform well in a certain environment and not at all in another environment. In face, in some uses, no one thickening agent is completely satisfactory and there is a continual need and a continuing search for new thickening agents to satisfy many unmet needs. For instance, various cellulose derivatives or other water-soluble polymers such as sodium polyacrylates, polyacrylamides and polyethylene glycol fatty acid diesters are representative thickening agents. The polyethylene glycol fatty acid diesters are widely used for textile printing emulsions, cosmetic emulsions, and aqueous pigment suspensions. These esters suffer from the defect that they are not resistant to hydrolysis in an acid or alkaline medium so that under such conditions the thickening effect initially obtained is gradually reduced.

Polyoxyalkylene compounds, including high molecular weight materials are well known for use as surface-active agents, as disclosed in U.S. Pat. No. 2,674,619. These compositions can be prepared at high molecular weights, for instance, up to 25,000 for use as aqueous thickeners. It is known that liquid polyoxyalkylenes can be obtained by utilizing a mixture of ethylene oxide and another lower alkylene oxide in an oxide ratio of from 75 to 90 percent ethylene oxide to 10 to 25 percent other lower alkylene oxides such as 1,2-propylene oxide, as taught in U.S. Pat. No. 2,425,755. The polyether polyols of the prior art having high thickening efficiency are generally those having the highest molecular weights reasonably obtainable under commercial conditions with price considerations being a limiting factor. Because high molecular weight polyethers require a disproportionately longer processing time to produce, it would be desirable to prepare high efficiency thickeners utilizing lower molecular weight polymers.

In U.S. Pat. No. 3,538,033, there are disclosed polyoxyalkylene derivatives of diepoxides having thickening properties. The thickener compositions disclosed are useful for thickening aqueous systems and are prepared by reacting a diepoxide compound having at least 12 carbon atoms with an alkylene oxide adduct containing from 100 to 250 moles of ethylene oxide units.

In U.S. Pat. No. 3,829,506, there are disclosed biodegradable surface-active agents having good foam properties and foam stabilizing characteristics prepared by copolymerizing ethylene oxide alone or with another lower alkylene oxide and an alpha-olefin oxide in the presence of a polyhydric alcohol. Molecular weights of 400 to 6000 are claimed but there is no indication that the compositions are useful as thickening agents for aqueous systems.

In U.S. Pat. No. 3,475,499, there is disclosed the preparation of glycols and glycol ethers by reacting with water 1,2-epoxides having 3 to 30 carbon atoms. The compositions are disclosed as useful in the preparation of detergents. High molecular weight polyether block polymers are disclosed in U.S. Pat. No. 3,535,307. Such compositions have molecular weights of about 2000 to about 25,000 and are useful in the preparation of polyurethanes.

SUMMARY OF THE INVENTION

Polyether-based thickeners are disclosed having a molecular weight in the range of about 1000 to about 25,000, preferably about 1000 to about 10,000, which are mixtures of a polyether, and an ethoxylated phosphate ester, or said ester and a water-soluble amine. The polyethers are prepared by reacting ethylene oxide or a mixture of ethylene oxide and at least one lower alkylene oxide having 3 to 4 carbon atoms in the presence of an active hydrogen-containing compound initiator having only one active hydrogen atom and about 12 to about 18 aliphatic carbon atoms and at least one alpha-olefin oxide having about 12 to about 18 carbon atoms. The thickeners of the invention are particularly suited to use in aqueous hydraulic fluids where viscosity stability under conditions of high shear and elevated temperatures is desirable.

DETAILED DESCRIPTION OF THE INVENTION

It is known that polyether thickening agents having greatly improved thickening efficiency over prior art high molecular weight polyethers can be obtained based upon the reaction of ethylene oxide with an active hydrogen-containing initiator having only 1 active hydrogen in combination with ethylene oxide and at least one lower alkylene oxide containing 3 to 4 carbon atoms and an alpha-olefin oxide having about 12 to about 18 carbon atoms or mixtures thereof. Compositions and processes are disclosed for these improved thickening agents in co-pending application Ser. No. 86,838, filed on even date herewith, now abandoned. Whether said alpha-olefin oxide is incorporated in the modified-polyether by copolymerization to produce a heteric polyether or by capping an ethylene oxide homopolymer or a heteric or block polyether, improved thickening efficiency without substantial reduction in viscosity stability under high shear conditions can be obtained. A further improvement in thickening efficiency can be obtained by combining the above-described alpha-olefin oxide-modified polyethers with at least one of an ethoxylated aliphatic phosphate ester or said ester and a water-soluble amine.

The thickeners of the invention are useful in the preparation of aqueous hydraulic fluids since the viscosity of thickened hydraulic fluids containing the thickeners of the invention is unexpectedly stable under high shear and high temperature conditions. Such conditions are encountered during use of aqueous hydraulic fluids in hydraulic systems utilizing vane type pumps.

The preparation of polyethers is well known in the art. Generally, polyethers are prepared utilizing a lower alkylene oxide, an active hydrogen containing compound, and an acid or basic oxyalkylation catalyst in the presence of an inert organic solvent at elevated temperatures in the range of about 50° C. to 150° C. under an inert gas pressure generally from about 20 to about 100 lbs. per square inch gauge.

Any suitable prior art alkaline oxyalkylation catalyst can be used in the practice of this invention. These include, for example, strong bases, such as sodium hydroxide, sodium methylate, potassium hydroxide, and the like; salts of strong bases with weak acids, such as sodium acetate, sodium glycolate, and the like and quaternary ammonium compounds, such as benzyl dimethyl cetyl ammonium compounds and the like. The concentration of these catalysts in the reaction mixture is not critical and may vary from about 0.1 percent to 5 percent by weight of the initiator compound.

An inert organic solvent may be utilized in the above-described procedures. The amount of solvent used is that which is sufficient to provide a suitable reaction medium and is generally, on a molar basis, in excess of the total amount of the reactants. Examples of suitable solvents include aliphatic hydrocarbons, such as hexane, heptane, isoheptane; aromatic hydrocarbons, such as benzene, toluene, xylene; chlorinated hydrocarbons, such as carbon tetrachloride, ethylene dichloride, propylene dichloride; and oxygenated hydrocarbons, such as diethyl ether, dimethyl ether, anisole, and the like.

In accordance with this invention, a copolymer polyether is prepared by mixing an alpha-olefin oxide having about 12 to about 18 aliphatic carbon atoms, ethylene oxide or ethylene oxide and at least one lower alkylene oxide having 3 to 4 carbon atoms with an active hydrogen-containing compound initiator having only one active hydrogen. Said initiator can be an aliphatic or alkylaromatic compound having about 12 to about 18 aliphatic carbon atoms. From about 5.0 moles to 15.0 moles of said alpha-olefin oxide per mole of said initiator is used. Reaction is effected by heating said mixture to a temperature in the range of about 50° C. to 150° C., preferably from 80° C. to 130° C., under an inert gas pressure preferably from about 30 p.s.i.g. to 90 p.s.i.g.

Where mixtures of ethylene oxide, said alpha-olefin oxide and other alkylene oxides having from three to four carbon atoms are used, the proportions of said mixture are chosen so that the resulting polyether polyol product will contain at least about 10 percent by weight, preferably about 70 percent to about 99 percent by weight, ethylene oxide residue. Said mixture is polymerized at a temperature and pressure in said range for a period of about one hour to ten hours, preferably one to three hours. Alternatively, an ethylene oxide homopolymer or block or heteric copolymers of ethylene oxide and at least one lower alkylene oxide having 3 to 4 carbon atoms can be prepared as intermediates. These are then capped with said alpha-olefin oxide to prepare the thickeners of this invention. If desired, a catalyst may be added to the reaction mixture prior to the ethylene oxide addition. Alkaline catalysts such as potassium hydroxide or acid catalysts such as boron trifluoride are useful, as is well established in the art.

As is well known in the art, polyethers are prepared utilizing an initiator compound which contains a reactive (or active) hydrogen atom. The term "reactive hydrogen atom" is well known and clearly understood by those skilled in the art. However, to remove any possible ambiguity in this regard, the term "reactive hydrogen atom", as used herein and in the appended claims, includes any hydrogen atom fulfilling the following two conditions:

1. It is sufficiently labile to open the epoxide ring of propylene oxide, and

2. It reacts with methyl magnesium iodide to liberate methane in the classical Zerewitinoff reaction (see Niederle and Niederle, Micromethods of Quantitative Organic Analysis, p. 263, John Wiley and Sons, New York City, 1946).

The reactive hydrogen atoms which will fulfill the above two conditions are normally activated by being a member of a functional group containing an oxygen atom, e.g., a hydroxyl group, a phenol group, a carboxylic acid group; a basic nitrogen atom, e.g., an amine group, a hydrazine group, an imine group, an amide group, a guanidine group, a sulfonamide group, a urea group, a thiourea group; or a sulfur atom, e.g., a mercaptan, a thiophenol, a thiocarboxylic acid, hydrogen sulfide. Alternatively, certain hydrogen atoms may be activated by proximity to carbonyl groups such as those found in cyanoacetic esters, acetoacetic esters, malonic esters, as is well known in the art.

Specific classes of initiator compounds which can be used in preparing polyoxyalkylene thickeners of the invention are aliphatic monoacids, aliphatic monohydric alcohols, alkylphenols, and aliphatic mercaptans wherein said initiator compounds contain about 12 to about 18 carbon atoms in the alkyl group thereof. The aliphatic monohydric alcohols include the alkane monoalcohols, alkene monoalcohols, and alkyne monoalcohols. Representative examples of useful initiators are stearic acid, oleic acid, stearyl alcohol, lauryl alcohol, myristyl alcohol, cetyl alcohol, dodecyl phenol, octodecyl phenol, dodecyl mercaptan, and octadecyl mercaptan. The preferred initiators are the aliphatic monohydric alcohols having a carbon atom chain length of 12 to 18 carbon atoms. Preferably, the carbon chain contains about 16 to about 18 carbon atoms. The use of octadecyl alcohol (stearyl alcohol) is particularly preferred.

The heteric or block copolymers of the invention which are copolymerized with an alpha-olefin oxide having about 12 to about 18 carbon atoms are mixtures with ethylene oxide of lower alkylene oxides having 3 to 4 carbon atoms. Generally, the proportion of ethylene oxide is at least 10 percent by weight, preferably is about 70 to about 99 percent by weight, and most preferably about 70 to about 90 percent by weight, of the mixture of ethylene oxide and the alkylene oxide having 3 to 4 carbon atoms. Heteric copolymers having the most preferred proportion of ethylene oxide are liquids. The lower alkylene oxides referred to are 1,2-propylene oxide and the butylene oxides such as 1,2-butylene oxide and 2,3-butylene oxide and tetrahydrofuran. The proportion of lower alkylene oxides having 3 to 4 carbon atoms utilized in combination with ethylene oxide is generally less than 50 percent by weight of the mixed copolymer and preferably is 30 to 10 percent by weight thereof.

The alpha-olefin oxides which are utilized to modify the polyether polyols of the prior art are those oxides generally containing about 12 to about 18, preferably about 14 to about 18, carbon atoms and the commercially available mixtures thereof. The amount of alpha-olefin oxide required to obtain the more efficient polyether thickening agents of the invention is about 1 to about 20 percent, preferably about 1 to about 10 percent, by weight of the total weight of the polyether polyol thickeners of the invention. This amount of alpha-olefin oxide based upon the molar amount of active hydrogen-containing initiator compound is about 5.0 mole to about 15.0 moles of alpha-olefin oxide per mole of monofunctional active hydrogen-containing initiator.

Preferably, the alpha-olefin oxide contains a mixture of about 14 to about 16 carbon atoms and linear alkyl chains. Examples of useful alpha-olefin oxides are those commercially available under the trademark VIKOLOX.

Since the preparation of heteric and block copolymers of alkylene oxides are well known in the art, further description of the preparation of heteric and block copolymers of mixed lower alkylene oxides is unnecessary. Further details of the preparation of heteric copolymers of lower alkylene oxide can be obtained in U.S. Pat. No. 3,829,506, incorporated herein by reference. Further information on the preparation of block copolymers of lower alkylene oxides can be obtained in U.S. Pat. No. 3,535,307, incorporated herein by reference.

Alternatively to the use of the above-described alpha-olefin oxides to modify high molecular weight polyethers, it is possible to substitute glycidyl ethers which can be prepared by reaction of an alcohol having 12 to about 18 carbon atoms with epichlorohydrin in accordance with the teachings of U.S. Pat. No. 4,086,279 and references cited therein, all incorporated by reference.

The useful water-soluble amines which act synergistically in combination with the ethoxylated phosphate esters in providing increased thickening efficiency of the above-described polyethers modified with alpha-olefin oxides are the water-soluble aliphatic, aromatic and cycloaliphatic amines including alkanol amines. Representative examples include methylamine, dimethylamine, trimethylamine, ethylamine, diethylamine, triethylamine, n-propylamine, di-n-propylamine, tri-n-propylamine, isopropylamine, n-butylamine, isobutylamine, secondary butylamine, tertiary butylamine, cyclohexylamine, benzylamine, alpha-phenylethylamine, beta-phenylethylamine, ethylenediamine, tetramethylenediamine, hexamethylenediamine, tetramethylammonium hydroxide, morpholine, N-methyl morpholine, N-ethyl morpholine, dimethylaminopropylamine, N,N-dimethylethanolamine, alpha- and gamma-picoline, piperazine, isopropylaminoethanol, N,N-dimethylcyclohexylamine, 2-amino-2-methyl-1-propanol.

The ethoxylated phosphate ester useful either alone or in combinations with the above-described water-soluble amines in providing increased efficiency of the above-described alpha-olefin oxide-modified polyether are those phosphate esters selected from the group consisting of:

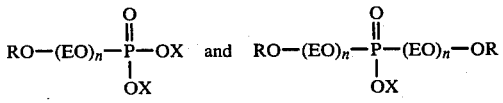

and mixtures thereof, wherein EO is ethylene oxide; R is selected from the group consisting of linear or branched chain alkyl groups having about 6 to about 30 carbon atoms, preferably about 8 to about 20 carbon atoms, aryl or arylalkyl groups wherein the arylalkyl groups have about 6 to about 30 carbon atoms, preferably about 8 to about 18 carbon atoms, and X is selected from the group consisting of the residue of hydrogen, ammonia or an amine and an alkali or alkaline earth metal or mixtures thereof and n is a number from 1–50. Metals such as lithium, sodium, potassium, rubidium, cesium, calcium, strontium and barium are examples of X. The phosphate ester compositions utilized in the compositions of the invention are more fully disclosed in U.S. Pat. Nos. 3,044,056 and 3,004,057.

In general, the phosphate esters employed are obtained by esterifying one mole of $P_2O_5$ with 2 to 4.5 moles of a nonionic surface active agent characterized as a condensation product of at least one mole of ethylene oxide with one mole of a compound having at least 6 carbon atoms and a reactive hydrogen atom. Such nonionic surface active agents are well known in the art and are generally prepared by condensing a polyglycol ether containing a suitable number of alkenoxy groups or a 1,2-alkylene oxide, or substituted alkylene oxide such as a substituted propylene oxide, butylene oxide or preferably ethylene oxide with an organic compound containing at least 6 carbon atoms and a reactive hydrogen atom. Examples of compounds containing a reactive hydrogen atom are alcohols, phenols, thiols, primary and secondary amines, and carboxylic and sulfonic acids and their amides. The amount of alkylene oxide or equivalent condensed with the reactive chain will depend primarily upon the particular compound with which it is condensed. Generally, an amount of alkylene oxide or equivalent should be employed which will result in a condensation product containing about 20 to 85 percent by weight of combined alkylene oxide. However, the optimum amount of alkylene oxide for attainment of the desired hydrophobic-hydrophilic balance may be readily determined in any particular case by preliminary test and routine experimentation.

The nonionic surface active agents used are preferably polyoxyalkylene derivatives of alkylated and polyalkylated phenols, multi-branched chain primary aliphatic alcohols having the molecular configuration of an alcohol produced by the oxo process from a polyolefin of at least 7 carbon atoms, and straight chain aliphatic alcohols of at least 10 carbon atoms. Examples of these derivatives and other suitable nonionic surface active agents which may be phosphated in accordance with the present invention are included below. In this list, "EO" means "ethylene oxide" and the number preceding same refers to the number of moles thereof reacted with one mole of the given reactive hydrogen containing compound.

Nonylphenol+9−EO
Nonylphenol+2 EO
Dinonylphenol+7 EO
Dodecylphenol+18 EO
Castor oil+20 EO
Tall oil+18 EO
Oleyl alcohol+4 EO
Oleyl alcohol+20 EO
Lauryl alcohol+4 EO
Lauryl alcohol+15 EO
Hexadecyl alcohol+12 EO
Hexadecyl alcohol+20 EO
Octadecyl alcohol+20 EO
Oxo tridecyl alcohol:
(From tetrapropylene)+7 EO
(From tetrapropylene)+10 EO
(From tetrapropylene)+15 EO
Dodecyl mercaptan+9 EO
Soya bean oil amine+10 EO
Rosin amine+32 EO
Coconut fatty acid amine+7 EO
Cocoa fatty acid+10 EO
Dodecylbenzene sulfonamide+10 EO
Decyl sulfonamide+6 EO
Oleic acid+5 EO Propylene glycol (30 oxypropylene units)+10 EO Increased thickening efficiency of the alpha-olefin oxide modified polyethers disclosed above is obtained by utilizing the aromatic or aliphatic ethoxylated phosphate ester described above alone or in mixtures thereof with a water-soluble amine, as described above. Surprisingly, greatly improved thickening efficiency can be obtained utilizing relatively minor amounts of either said mixture or the phosphate ester alone. Generally, at least about 0.5 percent by weight of either of said phosphate ester or said mixture of phosphate ester and water-soluble amine are utilized to provide the improved thickening efficiency with the above-described alpha-olefin oxide-modified polyethers. A mixture of about 20 to about 50 percent of said amine with about 80 to about 50 percent of said phosphate ester is generally used. Generally, a total of about 10 to about 35 percent, preferably about 10 to about 20 percent, by weight of said phosphate ester or the combination of said phosphate ester and said water-soluble amine, all based upon the total weight of the mixture of the modified polyether and phosphate ester and amine additives, is used. The proportion of polyetherutilized in thickening aqueous systems is an effective thickening proportion. Generally, about 5 percent to about 50 percent by weight, preferably about 10 percent to about 20 percent by weight is utilized in aqueous systems.

The following examples will illustrate the preparation of the alpha-olefin oxide-modified polyethers and mixtures thereof with the phosphate ester and amine additives of the invention. Where not otherwise specified throughout this specification and claims, temperatures are given in degrees centigrade and parts, percentages and proportions are by weight.

EXAMPLE 1

(Control or Comparative Example)

A conventional polyether derived from ethylene oxide and 1,2-propylene oxide in the ratio of 75 percent ethylene oxide and 25 percent 1,2-propylene oxide was prepared by reaction with trimethylolpropane in two stages in a stainless steel autoclave. An intermediate product was first prepared by reacting a mixture of trimethylolpropane, potassium hydroxide, propylene oxide, and ethylene oxide for a period of 18 hours at 120° C. The cooled liquid product was discharged into a glass container.

The final product was prepared by reacting this intermediate product with 1,2-propylene oxide and ethylene oxide under a nitrogen atmosphere at 115° C. for 22 hours. The reaction mixture was then cooled and the viscous liquid product transferred to a glass container. The product had a molecular weight of about 23,000.

EXAMPLE 2

In this example, a heteric copolymer of ethylene oxide and propylene oxide having a theoretical molecular weight of 8717 is prepared. This intermediate is subsequently further reacted with an alpha-olefin oxide which is a mixture of alpha-olefin oxides having 15 to 18 carbon atoms.

Into a stainless steel one-gallon autoclave, there was charged 972 grams of stearyl alcohol, 89.6 grams of a 45 percent by weight aqueous solution of potassium hydroxide and the mixture was heated with stirring at 115° C. at a pressure of less than 10 millimeters of mercury for 30 minutes. The vacuum was relieved with dry nitrogen to a pressure of 5 pounds per square inch gauge, and a mixture of 407 grams of propylene oxide and 1220 grams of ethylene oxide were added over a period of 4¾ hours at a temperature of 115° C. After addition was complete, the mixture was stirred 70 minutes at 115° C. and cooled to 80° C. The product labeled intermediate No. 1 was thereafter discharged to a one gallon glass bottle for use in the next step.

Using the previously prepared intermediate, 476 grams of said intermediate were charged to a one-gallon stainless steel autoclave which had been previously flushed with nitrogen and heated for 15 minutes at a temperature of 115° C. and a pressure of 10 millimeters of mercury. After relieving the vacuum to a pressure of 5 pounds per square inch gauge with nitrogen, a mixture of 1303 grams of propylene oxide and 3909 grams of ethylene oxide were added over a period of 14 hours at a temperature of 115° C. After the addition of these ingredients was complete, the mixture was stirred for a period of two hours at a temperature of 115° C. and then cooled to 80° C. The second intermediate product was discharged to a one-gallon bottle in a yield of 5549 grams of liquid intermediate.

Utilizing a 2600 grams portion of the above second intermediate product, a five-liter glass vessel was charged therewith and thereafter the vessel and its contents were heated at a temperature of 120° C. under a nitrogen atmosphere at a pressure of 20 millimeters of mercury for a period of 30 minutes. Thereafter, 76 grams of a mixture of alpha-olefin oxides having 15 to 18 carbon atom chains and sold under the trademark VIKOLOX 15-18 by the Viking Chemical Company was added all at once. After heating this mixture for a period of 8 hours at a temperature of 120° C. under a nitrogen atmosphere at atmospheric pressure, the product was cooled to 80° C. and discharged to a glass container. The product was characterized as a viscous brown liquid at room temperature. A 10 percent by weight aqueous solution was found to have a viscosity of 1320 (SUS) at 100° F.

EXAMPLE 3

(Control or Comparative Example)

A thickened water solution was prepared containing 10 percent by weight of the polyether of Example 1 in combination with 0.5 percent by weight of ethanolamine, 1.0 percent by weight of the ester prepared by reacting two moles of phosphorus pentoxide with one mole of the condensation product to one mole of oleyl alcohol and four moles of ethylene oxide. The sample had a viscosity (SUS) at 100° F. of 55.

EXAMPLE 4

Utilizing the polyether of Example 2, a 10 percent by weight aqueous solution was prepared in combination with 0.05 percent by weight of ethanolamine and 1.0 percent by weight of the ester prepared by reacting two moles of phosphorus pentoxide with one mole of the condensation product of one mole of oleyl alcohol and four moles of ethylene oxide. The sample had a viscosity (SUS) at 100° F. of 3222.

While this invention has been described with reference to certain specific embodiments, it will be recognized by those skilled in the art that many variations are possible without departing from the spirit and scope of the invention and it will be understood that it is intended to cover all changes and modifications of the invention disclosed herein for the purposes of illustration which do not constitute departures from the spirit and scope of the invention.

The embodiments of the invention in which an exclusive property or privilege is claimed are defined as follows:

1. A polyether-based thickener for an aqueous system comprising in admixture:

A. a polyether having a molecular weight of about 1000 to about 25,000 which is selected from the group consisting of (1) polyethers prepared by reacting a mixture of ethylene oxide and at least one lower alkylene oxide having 3 to 4 carbon atoms with at least one active hydrogen-containing aliphatic or alkyl aromatic compound containing no more than one active hydrogen and about 12 to about 18 aliphatic carbon atoms and at least one glycidyl ether having a carbon chain length of about 12 to about 18 aliphatic carbon atoms and wherein said glycidyl ether is present in the amount of about 1 to about 20 percent by weight based upon the total weight of said polyether, and (2) polyethers prepared by reacting ethylene oxide and at least one lower alkylene oxide having 3 to 4 carbon atoms with at least one active hydrogen compound containing no more than one active hydrogen and about 12 to about 18 aliphatic carbon atoms to prepare a heteric or block copolymer and further reacting said copolymer with at least one glycidyl ether having a carbon chain length of about 12 to about 18 aliphatic carbon atoms and wherein said glycidyl ether is present in the amount of about 1 to about 20 percent by weight based on the total weight of said thickener, and (3) polyethers prepared by reacting (a) ethylene oxide and at least one glycidyl ether with at least one active hydrogen compound containing no more than one active hydrogen to prepare a heteric copolymer or (b) ethylene oxide with at least one active hydrogen compound containing at no more than one active hydrogen to prepare a homopolymer and further reacting said homopolymer with at least one glycidyl ether, said glycidyl ether having a carbon chain length of about 12 to about 18 aliphatic carbon atoms and wherein said active hydrogen compound is an aliphatic or alkylaromatic compound containing about 12 to about 18 aliphatic carbon atoms and said glycidyl ether is present in the amount of about 1 to about 20 percent by weight based on the total weight of said thickener, and about 10 to about 35 percent by weight based upon the total weight of said polyether polyol-based thickener of:

B. a mixture of a water-soluble amine and an ethoxylated phosphate ester, or an ethoxylated phosphate ester, wherein said phosphate ester is selected from the group consisting of

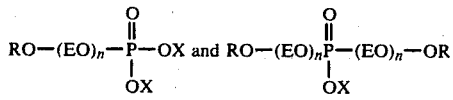

and mixtures thereof, wherein EO is ethylene oxide; R is selected from the group consisting of linear or branched chain alkyl groups having about 6 to about 30 carbon atoms, and aryl or alkylaryl groups wherein said arylalkyl groups have about 6 to about 30 carbon atoms; X is selected from the group consisting of the residue of hydrogen, ammonia, an amine, an alkali or alkaline earth metal and mixtures thereof; and n is a number from 1 to 50.

2. The thickener of claim 1 wherein said polyether is prepared by copolymerizing a mixture of said reactants to produce a heteric copolymer and wherein said mixture includes said water-soluble amine and said phosphate ester in the proportion by weight of about 20 to about 50 percent of said amine and about 80 to about 50 percent by weight of said phosphate ester based upon the total weight of said amine and phosphate ester.

3. The thickener of claim 1 wherein said polyether is prepared by copolymerizing a mixture of ethylene oxide and at least one of said lower alkylene oxides to produce a heteric copolymer intermediate and subsequently reacting said intermediate with at least one of said glycidyl ether.

4. The thickener of claim 3 wherein said lower alkylene oxides are selected from the group consisting of propylene oxide, 1,2-butylene oxide, 1,3-butylene oxide, 1,4-butylene oxide, 2,3-butylene oxide and tetrahydrofuran and wherein the proportion of ethylene oxide in said polyether is at least 10 percent by weight of the total weight of said thickener.

5. The thickener of claim 4 wherein the proportion of ethylene oxide to said lower alkylene oxides is from about 70 to about 90 percent by weight of ethylene oxide to about 30 to about 10 percent by weight of the said lower alkylene oxides and said active hydrogen containing compound is an aliphatic monohydric alcohol.

6. The thickener of claim 5 wherein said monohydric alcohol is selected from the group consisting of alkane monoalcohols, alkene monoalcohols, and alkyne monoalcohols.

7. The thickener of claim 6 wherein said glycidyl ether has about 14 to about 18 carbon atoms, said alkane monoalcohol is selected from the group consisting of at least one of stearyl alcohol, lauryl alcohol, myristyl alcohol, and cetyl alcohol, the ratio of said monoalcohol to said glycidyl ether is about 1:5 to about 1:15 and wherein said phosphate ester is the ester of two moles of phosphorus pentoxide and one mole of the condensation product of one mole of oleyl alcohol and 4 moles of ethylene oxide.

8. The thickener of claim 7 wherein said monoalcohol is stearyl alcohol, said lower alkylene oxide is propylene oxide, and said water-soluble amine is ethanolamine.

9. The thickener of claim 1 wherein said polyether is prepared by sequentially reacting ethylene oxide with at least one of said lower alkylene oxides to produce a block copolymer intermediate and subsequently reacting said intermediate with at least one of said glycidyl ether.

10. The process of thickening an aqueous system comprising the addition of an effective thickening amount of a polyether-based thickening agent to said aqueous system, said polyether-based thickening agent comprising in admixture:

A. a polyether having a molecular weight of about 1000 to about 25,000, which is selected from the group consisting of (1) polyethers prepared by reacting a mixture of ethylene oxide and at least one lower alkylene oxide having 3 to 4 carbon atoms with at least one active hydrogen-containing aliphatic or alkylaromatic compound containing no more than one active hydrogen and about 12 to about 18 carbon atoms and at least one glycidyl ether having a carbon chain length of about 12 to about 18 aliphatic carbon atoms and wherein said glycidyl ether is present in the amount of about 1 to about 20 percent by weight based upon the total weight of said polyether, (2) polyethers prepared by reacting ethylene oxide and at least one lower alkylene oxide having 3 to 4 carbon atoms with at least one active hydrogen compound containing no more than one active hydrogen and about 12 to about 18 aliphatic carbon atoms to prepare a heteric or block copolymer and further reacting said copolymer with at least one glycidyl ether having a carbon chain length of about 12 to about 18 aliphatic carbon atoms and wherein said glycidyl ether is present in the amount of about 1 to about 20 percent by weight based on the total weight of said thickener, and (3) polyethers prepared by reacting (a) ethylene oxide and at least one glycidyl ether with at least one active hydrogen compound containing no more than one active hydrogen to prepare a heteric copolymer or (b) ethylene oxide with at least one active hydrogen compound containing no more than one active hydrogen to prepare a homopolymer and further reacting said homopolymer with at least one glycidyl ether, said glycidyl ether having a carbon chain length of about 12 to about 18 aliphatic carbon atoms and wherein said glycidyl ether is present in the amount of about 1 to about 20 percent by weight based on the total weight of said thickener, and about 10 to about 35 percent by weight based upon the total weight of said polyether-based thickener of:

B. a mixture of a water-soluble amine and an ethoxylated phosphate ester, or an ethoxylated phosphate ester, wherein said phosphate ester is selected from the group consisting of

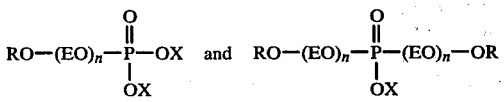

and mixtures thereof, wherein EO is ethylene oxide; R is selected from the group consisting of linear or branched chain alkyl groups having about 6 to about 30 carbon atoms, and aryl or alkylaryl groups wherein said arylalkyl groups have about 6 to about 30 carbon atoms; X is selected from the group consisting of the residue of hydrogen, ammonia, an amine, an alkali or alkaline earth metal and mixtures thereof; and n is a number from 1 to 50.

11. The process of claim 10 wherein said polyether is a liquid heteric copolymer prepared by copolymerizing a mixture of said ethylene oxide with at least one of said lower alkylene oxides, at least one of said active hydrogen containing compound, and at least one of said glycidyl ethers and wherein said phosphate ester is the ester of the reaction of two moles of phosphorus pentoxide with one mole of the condensation product of one mole of oleyl alcohol and four moles of ethylene oxide.

12. The process of claim 10 wherein said polyether is prepared by polymerizing a mixture of ethylene oxide and at least one of said lower alkylene oxides to prepare a liquid heteric copolymer intermediate which is subsequently capped with said glycidyl ether.

13. The process of claim 10 wherein said polyether thickening agent is the reaction product of the sequential polymerization of ethylene oxide and at least one of said lower alkylene oxides to prepare an intermediate which is subsequently capped with said glycidyl ether.

14. The process of claim 10 wherein said ethylene oxide is present in said polyether in an amount of at least 50 percent by weight of the weight of said polyether and said lower alkylene oxide is selected from the group consisting of propylene oxide, the butylene oxides, tetrahydrofuran, and mixtures thereof.

15. The process of claim 14 wherein the proportion of said ethylene oxide to said lower alkylene oxide in said polyether is in the amount of about 70 to about 90 percent by weight, said lower alkylene oxide is present in the amount of about 30 to about 10 percent by weight and said active hydrogen containing compound is an aliphatic monohydric alcohol.

16. The process of claim 15 wherein said monohydric alcohol is selected from the group consisting of alkane monoalcohols, alkene monoalcohols, and alkyne monoalcohols.

17. The process of claim 16 wherein said monohydric alcohol is selected from the group consisting of at least one of stearyl alcohol, lauryl alcohol, myristyl alcohol, and cetyl alcohol and wherein said phosphate ester is the ester of two moles of phosphorus pentoxide and one mole of the condensation product of one mole of oleyl alcohol and four moles of ethylene oxide.

18. The process of claim 17 wherein the ratio of said monoalcohol to said glycidyl ether is 1:5 to 1:15 on a molar basis.

19. The process of claim 16 wherein said aqueous system comprises water or a mixture of water and ethylene glycol.

20. The process of claim 19 wherein said polyether is a liquid at ambient temperatures, and said polyether is prepared by the heteric polymerization of a mixture of ethylene oxide and propylene oxide with stearyl alcohol as initiator to produce an intermediate heteric copolymer which is subsequently capped with said glycidyl ether, having about 14 to about 18 aliphatic carbon atoms in the chain, to produce a polyether having a molecular weight of about 1000 to about 10,000 and wherein said amine is ethanolamine.

* * * * *

UNITED STATES PATENT AND TRADEMARK OFFICE

CERTIFICATE OF CORRECTION

PATENT NO. : 4,395,351

DATED : July 26, 1983

INVENTOR(S) : Ronald L. CAMP

It is certified that error appears in the above-indentified patent and that said Letters Patent is hereby corrected as shown below:

On title page, item [73] insert the following:

Assignee: BASF Corporation
Parsippany, New Jersey

Signed and Sealed this

Third Day of May, 1994

Bruce Lehman

*Attest:*

BRUCE LEHMAN

*Attesting Officer*

*Commissioner of Patents and Trademarks*